US011307010B2

(12) United States Patent
Hucker

(10) Patent No.: US 11,307,010 B2
(45) Date of Patent: Apr. 19, 2022

(54) FUZE INDICATION SYSTEM

(71) Applicant: BAE SYSTEMS plc, London (GB)

(72) Inventor: Martyn John Hucker, USK Monmouthshire (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 17/057,377

(22) PCT Filed: May 30, 2019

(86) PCT No.: PCT/GB2019/051476
§ 371 (c)(1),
(2) Date: Nov. 20, 2020

(87) PCT Pub. No.: WO2019/229441
PCT Pub. Date: Dec. 5, 2019

(65) Prior Publication Data

US 2021/0190465 A1 Jun. 24, 2021

(30) Foreign Application Priority Data

Jun. 1, 2018 (EP) ..... 18275075
Jun. 1, 2018 (GB) ..... 1808992

(51) Int. Cl.
*F42C 21/00* (2006.01)
*F42C 11/00* (2006.01)

(52) U.S. Cl.
CPC ..... *F42C 21/00* (2013.01); *F42C 11/008* (2013.01)

(58) Field of Classification Search
CPC ..... A63H 27/005; B64G 1/002; B64G 1/62; B64G 1/641; F41A 9/61; F41J 9/16;
(Continued)

(56) References Cited

U.S. PATENT DOCUMENTS 4,147,109 A 4/1979 Ziemba
7,886,668 B2 * 2/2011 Hugus ..... F42B 12/76 102/517

(Continued)

FOREIGN PATENT DOCUMENTS

DE 102014005833 A1 10/2015
FR 1578063 A 8/1969

(Continued)

OTHER PUBLICATIONS

International Preliminary Report on Patentability received for PCT Application No. PCT/GB2019/051476, dated Dec. 10, 2020. 11 pages.

(Continued)

*Primary Examiner* — Michael D David
(74) *Attorney, Agent, or Firm* — Finch & Maloney PLLC

(57) ABSTRACT

A device for monitoring the status of a munition fuze is disclosed. The device includes a visible marker; an indicator strip, capable of actuation, from a first state to a second state; and a power source providing power to the munition initiation system, the visible marker and/or the indicator strip. The visible marker and indicator strip are positioned to be visible to an observer when the fuze has been fitted for use on said munition and activation of the power source causes switching of the visible marker from an off state to an on state and actuation of the indicator strip from a first state to a second state, such that the power source's activation is indicated by the actuation of the indicator strip to its second state. The visible marker remains in an on state only if there is sufficient power to operate the initiation system.

20 Claims, 2 Drawing Sheets

(58) Field of Classification Search
CPC ... F41J 9/18; F42B 10/26; F42B 10/56; F42B 12/202; F42C 21/00; F42C 11/008
USPC ..... 102/202.1–202.5
See application file for complete search history.

(56) References Cited

U.S. PATENT DOCUMENTS

| | | | | |
|---|---|---|---|---|
| 8,250,985 | B2 * | 8/2012 | Hugus | F42B 12/44 102/494 |
| 2007/0125256 | A1 | 6/2007 | Frickey et al. | |
| 2008/0078368 | A1 * | 4/2008 | Taylor | F41A 9/64 124/49 |
| 2010/0237197 | A1 | 9/2010 | Rosenfield et al. | |
| 2014/0083402 | A1 | 3/2014 | Fridman et al. | |
| 2021/0231401 | A1 * | 7/2021 | Salomon | F41J 9/14 |

FOREIGN PATENT DOCUMENTS

| | | | | |
|---|---|---|---|---|
| FR | 2712128 | A1 * | 5/1995 | H04B 7/18504 |
| WO | 2019229441 | A1 | 12/2019 | |

OTHER PUBLICATIONS

International Search Report and Written Opinion received for PCT Application No. PCT/GB2019/051476, dated Aug. 23, 2019. 18 pages.
GB Search Report under Section 17(5) received for GB Application No. 1808992 0, dated Nov. 26, 2018. 3 pages.
Extended European Search Report received for EP Application No. 18275075.2, dated Nov. 29, 2018. 11 pages.

* cited by examiner

FUZE INDICATION SYSTEM

The invention relates to an indication system to display unintended power displacement in munition fuzes, for example fuzes with an electronically initiation means.

Within the field of munitions, many artillery and mortar projectiles contain fuzes, which may be mechanically or electronically initiated. As part of this initiation chain some munitions may employ batteries to provide electrical power during operation. Typically the batteries used in munitions do not provide a current until activated by the launch environment associated with the munition the fuze is controlling, however it is known that various storage and handling conditions, such as, for example the dropping of a munition, can cause unintentional activation of the battery causing a concern for both safety and subsequent operational effectiveness.

Munitions incorporating an electrically initiated firing means, such as electric detonators, exploding bridge wires, exploding foils etc. have a greater potential for unintended activation of the power source as electrical power is present within the fuze. Safety standards provided in NATO standardisation agreement (STANAG) 4187 requires that "positive, direct and unambiguous means of determining that the fuzing system is not armed during and after assembly and when installing the system into a munition", are required to be met by munition manufacturers. It can be achieved in a number of ways, however may be different for each munition depending on its intended functionality and construction. For fuzes with a mechanical interruption means it is possible to determine their state (SAFE or ARMED) by visual inspection prior to installation or by using Non-Destructive Testing (NDT) methods such as X-Ray post assembly. This cannot be done for electronically controlled systems as there is no visual change in the device when changing between a safe state and armed state. This may be a safety issue, but also an operation issue as a fuze battery, if activated unintentionally, for example during transport or storage, would eventually discharge and may not be capable of supplying the required power to the fuze during operation at a later date resulting in the munition failing to function as intended.

To help in addressing the issue where electrical power needs to be monitored as part of the munition there needs to be a direct indication that electrical power is present in the power source within the fuze and there must be a direct ability to detect and indicate that the power source has been activated at some point, with this indication being detectable following the eventual absence of power.

The invention herein aims to address the issues presented in the background prior art to address safety and operational concerns.

According to a first aspect of this invention there is provided a device for monitoring the status of a munition fuze, said device comprising; a visible marker capable of being switched between an off state and an on state; an indicator strip, capable of actuation, from a first state to a second state; a power source, capable of activation, wherein the power source provides power to the munition initiation system, the visible marker and/or the indicator strip; wherein said visible marker and indicator strip are positioned to be visible to an observer when the fuze has been fitted for use on said munition; and wherein activation of the power source causes switching of the visible marker from an off state to an on state and actuation of the indicator strip from a first state to a second state, such that the power source's activation is indicated by the actuation of the indicator strip to its second state; and wherein the visible marker remains in an on state only if there is sufficient power to operate the initiation system.

The device indicates whether or not sufficient electrical power is present in the power source and/or that the fuze may be in an armed, ready state. The activation of the power source causes the visible marker to turn from an off state to an on state, which provides a visual cue to an observer that the power source has been activated and that there is a supply of power from the power source to both the visible marker and the initiation system.

The visible marker should preferably only draw a minimum of electrical power from the power source, without causing undue strain to the power source, to avoid draining the power source of its stored charge. As a result it is preferred that the visible marker be able to operate at as low of a current as possible, enabling the life of the power source to be as long as possible before being depleted.

Preferably the visible marker is a light source and may be a bulb, laser diode, or a Light Emitting Diode (LED), preferably an LED, as they have low power consumption to illumination ratio.

In an alternative arrangement the visible marker may be a mechanical indicator active in a first and second state. In a first state a mechanical shutter may cover a visually distinct surface, such as, for example a reflective surface. If the power source is activated the mechanical indicator moves to the second state where the mechanical shutter exposes the visually distinct surface. Mechanical indicators in use with a reflective surface have the advantage of not drawing a current as they reflect ambient light, however are more complex to construct.

In order to provide as much information to the observer as possible the visible marker remains on while the power source retains the means for providing an electronic charge large enough to operate the initiation system of the munition. This will allow a munition to be assessed for its potential use, detailing whether sufficient charge remains within the power source even if it has suffered stimulus, causing the power source to activate unintentionally.

The initiation system of the munition may be held in the power source. This power source may be storage medium such as a battery, such as, for example a primary battery, reserve battery and/or capacitors. Reserve batteries typically require a positive stimulus to activate, such as for example, movement of the electrolyte, electrodes, or exposure to heat. Unintended activation of reserve batteries may occur due to brief exposure to one of these stimuli.

The visible marker shows unintended activation of the power source, however if the fuze has not been inspected by the observer for some time, for example due to being in transport or storage, it may be that, following unintended activation of the power source, the visible marker is unable to draw enough current from the power source to enable it to remain in an on state or that there is insufficient power in the power source to operate the initiation system, and so may not display to the observer that the power source has been enabled. As a result, after an extended period of being active the visible marker may no longer function and return to an off state, giving the impression to the observer that the fuze retains a sufficient power source.

To ensure that the unintended activation of a power source can be displayed, the indicator strip provides a permanent indication that the power source has been activated. The indicator strip reacts to a stimulus to actuate from a first state to a second state, such that said second state shows to the user that the power source has functioned.

The indicator strip may be any indicator that undergoes a visually distinct change to show that the power source has functioned. Preferably the indicator strip is an irreversible indicator strip, such that once the power source has functioned, the irreversible indicator strip remains in the changed state so that the observer may know the power source has functioned, even if the visible marker is inactive (due to poor power supply for example).

Preferably the indicator strip does not require electrical power to remain in the second state, ie the changed state.

The indicator strip may be capable of being "re-set" or replaced, but only by specific i.e. intended intervention by a skilled operative, preferably as part of specific maintenance.

The indicator strip may provide a clear visual notification to the user that the power source has been activated. The visual notification may be change in physical appearance, such as, for example, colour, physical state, motifs, insignias etc.

The indicator strip may be actuated by any suitable stimulus, such as, for example direct electrical stimulus or a thermal stimulus.

The indicator strip may, for example react to a temperature change, such as that provided by a heating element connected to the power source, wherein said heating element is thermally linked to the indicator strip. If the power source is unintentionally activated, the heating element will also be activated, which may cause the indicator strip to melt, deform, char, burn, change colour, react, etc., thereby causing a clear visual notification to the user that the power source has been activated.

The heating element may be any heating element that may be powered from an electrical current. In a preferred arrangement the heating element is a resistive heating element. A resistive heating element will increase in temperature once the power source is activated, causing a flow of current to pass through the heating element. This will cause a reaction to the thermochromic indicator strip, indicating that the power source has been active at some point.

In one arrangement the indicator strip may be a thermochromic indicator strip, wherein the application of heat from the heating element will cause the strip to change colour. This colour change may be as simple as one primary colour to another, indicating the application of heat (and so power has been provided to the heating element via the power source) or the reaction may cause a message to be displayed, such as a written or picture message, which was previously hidden by the first colour prior to the heat application. To prevent the possibility of a false positive, where the thermochromic strip may change colour without the aid of the heating element, the resistance to heat of the thermochromic indicator strip must be higher than that of the natural surrounding environment, for example average room temperature in storage or transport. This may well be different depending on the country the fuze is in and as a result the thermochromic indicator strip should be chosen with a suitable degree of tolerance. It is considered that any thermochromic indicator strip used should be activated by a temperature in the range of from 90 to 120° C. It is further considered the activation of the thermochromic indicator strip used should have a tolerance of plus or minus 5° C.

In a further arrangement the indicator strip may be formed from an electrochromic material, such that a change in colour is actuated by the passing of an electric current through the indicator strip, showing that the power source has been activated. This allows the omission of any heating element and enables the operation of the indicator strip using less current than using a heating element and thermochromic indicator strip. As a result there may be less energy drain on the power source.

The indicator strip may be a mechanically activated indicator strip. Passage of current from the power source may cause mechanical movement of shutters, indicators etc. to be moved in or out of alignment to the observer, to indicate that the indicator strip has functioned and thereby that the power source has been functioned. In one arrangement an electrically fusible wire may be caused to fail by the current, said wire which restrains a spring-loaded, bi-coloured indicator. This allows the sprung mechanism to move to reveal an alternative colour by utilising a mechanical slider or cover. Once the sprung mechanism has activated the indicator may stay in this state until an intended action, such as resetting the mechanism, is carried out intentionally, by a skilled operative.

In a further arrangement the current provided by the power source may be passed through a bi-metallic strip comprising at least two metals. As the current causes the temperature of the bi-metallic strip to increase, at least one of the two metals deforms, causing a bi-stable indicator mechanism to permanently move from a first position to a second position following the application of the current and thereby displaying a visual change, such as a change in colour.

In a yet further arrangement the indicator may be an electromagnetically driven mechanical slide. The current provided by the power source may drive the mechanical slide to either cover or display a message or other visual notification, such as a change in colour, indicating that the power source has been activated.

Whilst the invention has been described above, it extends to any inventive combination of the features set out above, or in the following description, drawings or claims.

Exemplary embodiments of the device in accordance with the invention will now be described with reference to the accompanying drawings in which:—

Figure 1:
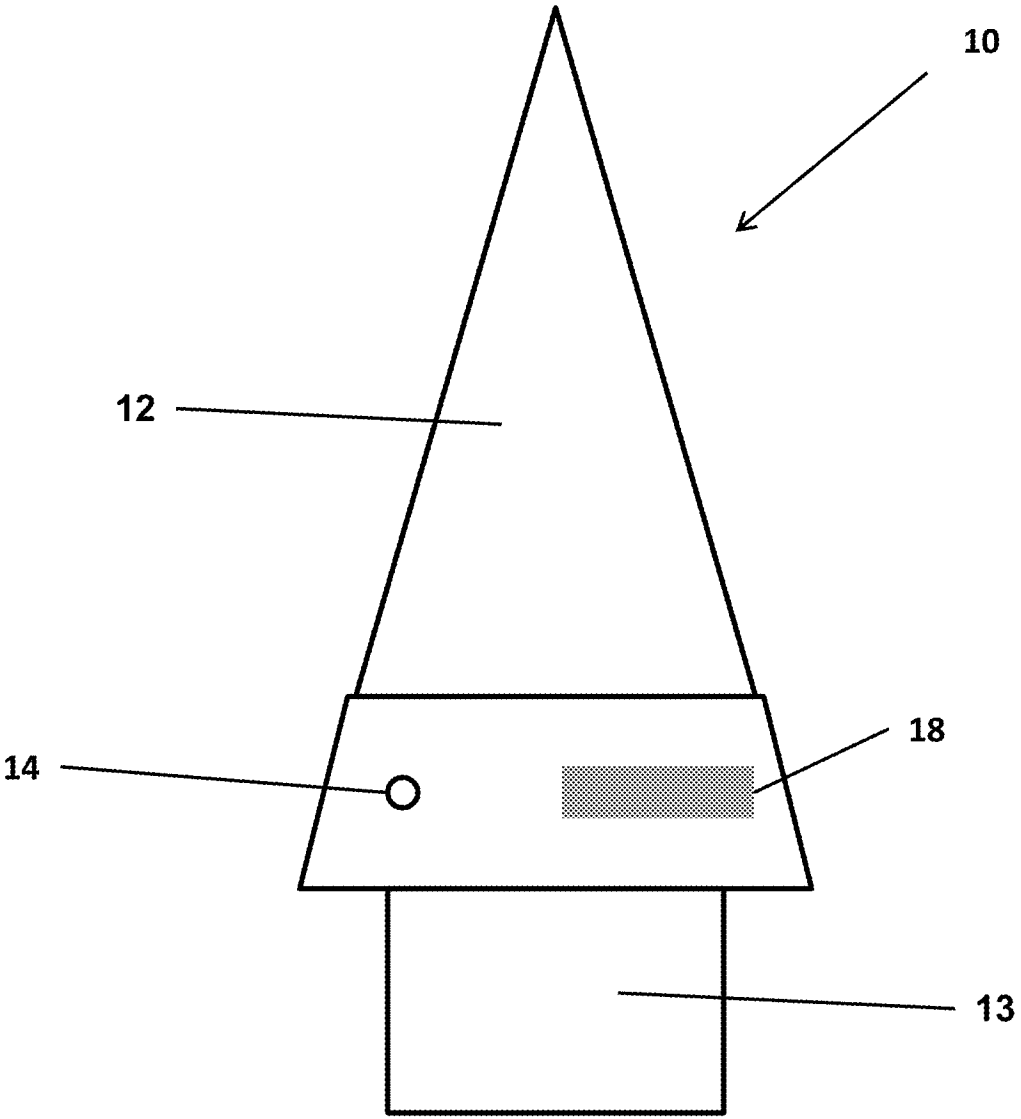
FIG. 1 shows a schematic view of a fuze with indicator strip and light emitting source visible to the observer.

Referring to FIG. 1, there is shown a fuze 10 with a warhead 12 and an insertion portion 13. On the front of the fuze 10, in a position that may be viewed by an observer (not shown), there is a visible marker 14, present to highlight when power is provided to the fuze 10 initiation systems, this may have been unintentional and as a result of environmental or physical stimulus such as a knock or drop. Activation of the power source (not shown) will supply current to the visible marker turning it from an off state to an on state and will remain in the on state until the visible marker is manually reset and when power remains in the power source (not shown), that is sufficient to operate the fuze 10 initiation systems. A thermochromic irreversible indicator strip 18 is also present, in view of the observer (not shown). In the event of the power source (not shown) being activated, a current is supplied to a heating element (not shown), which increases in heat causing an irreversible reaction to the thermochromic irreversible indicator strip 18, changing its colour and showing that the power source (not shown) has been activated.

Figure 2:
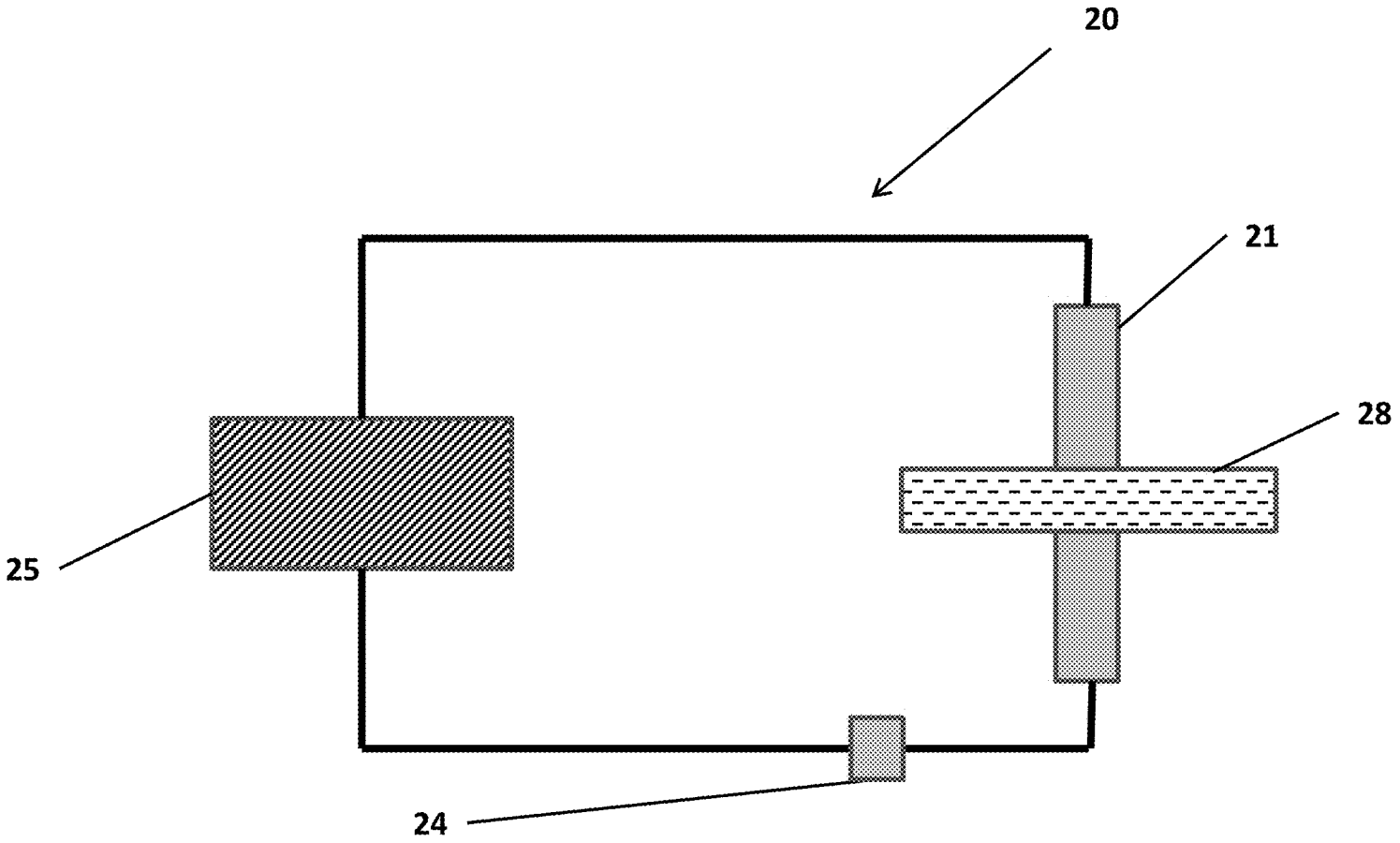
FIG. 2 shows a circuit diagram depicting an example design for the layout of the fuze components.

Referring to FIG. 2, there is shown a circuit diagram, wherein there is a fuze 20 circuit with a power source 25. If the power source 25 initiates then the current will pass through the visible marker 24 and the resistive heating element 21, which would cause the visible marker to switch from an off position to an on position and the resistive heating element 21 to increase in temperature by the current passing through the resistive heating element 21. The heat from the resistive heating element 21 causes the thermochromic irreversible indicator strip 28 to undergo a reaction after reaching a certain temperature, changing from a base colour to a different colour, indicating that the power source 25 has been activated.

The invention claimed is:

1. A device configured to monitor the status of a fuze of a munition, the device comprising:

a visible marker configured to be switched between an off state and an on state;

an irreversible indicator strip configured to be actuated from a first state to a second state; and a power source configured to provide power to an initiation system in the fuze, the visible marker and/or the indicator strip;

wherein said visible marker and indicator strip are configured to be positioned on the munition such that they are visible to an observer of said munition;

wherein the power source is configured to cause switching of the visible marker from the off state to the on state, and actuation of the indicator strip from the first state to the second state, such that activation of the power source is indicated by the actuation of the indicator strip to the second state; and wherein the visible marker is configured to remain in the on state only if there is sufficient power to operate the initiation system.

2. The device according to claim 1, where the visible marker includes a light source.

3. The device according to claim 2, wherein the light source includes a Light Emitting Diode (LED).

4. The device according to claim 1, wherein the visible marker is configured to switch to the on state prior to intended activation, thereby indicating unintended activation.

5. The device according to claim 1, wherein the power source includes a battery.

6. The device according to claim 1, wherein the power source includes a reserve battery.

7. The device according to claim 1, wherein the indicator strip is a thermochromic or electrochromic indicator strip.

8. The device according to claim 1, wherein the indicator strip is actuated by a heating element, wherein said heating element is connected to the power source.

9. The device according to claim 8, wherein the heating element is a resistive heating element.

10. The device according to claim 8, wherein the temperature of actuation of the indicator strip is in the range of from 90 to 120° C.

11. The device according to claim 1, wherein the indicator strip has a tolerance of plus or minus 5° C. before activation.

12. The device according to claim 1, wherein the visible marker and indicator strip are located in a separate housing which is retrofittable to the munition, such that the housing operatively engages with the munition's power source.

13. A munition comprising the device according to claim 1.

14. A device configured to monitor the status of a fuze of a munition, the device comprising:

a visible marker configured to be switched between an off state and an on state, wherein the visible marker includes a light source;

an indicator strip configured to be actuated from a first state to a second state, wherein the indicator strip includes an irreversible indicator strip; and a heating element configured to actuate the indicator strip, the heating element connectable to a power source;

wherein said visible marker and indicator strip are configured to be positioned on the munition such that they are visible to an observer of said munition;

wherein the power source is configured to cause switching of the visible marker from the off state to the on state, and actuation of the indicator strip from the first state to the second state, such that activation of the power source is indicated by the actuation of the indicator strip to the second state; and wherein the visible marker is configured to remain in the on state only if there is sufficient power to operate an initiation system of the fuze.

15. The device according to claim 14, wherein the light source includes a Light Emitting Diode (LED).

16. The device according to claim 14, wherein the visible marker is configured to switch to the on state prior to intended activation, thereby indicating unintended activation.

17. The device according to claim 14, wherein the power source includes a battery.

18. A device configured to monitor the status of a fuze of a munition, the device comprising:

a visible marker configured to be switched between an off state and an on state, wherein the visible marker includes a Light Emitting Diode (LED);

an indicator strip configured to be actuated from a first state to a second state, wherein the indicator strip includes an irreversible indicator strip; and a heating element configured to actuate the indicator strip, the heating element connectable to a power source;

wherein said visible marker and indicator strip are configured to be positioned on the munition such that they are visible to an observer of said munition;

wherein the power source is configured to cause switching of the visible marker from the off state to the on state, and actuation of the indicator strip from the first state to the second state, such that activation of the power source is indicated by the actuation of the indicator strip to the second state;

wherein the visible marker is configured to remain in the on state only if there is sufficient power to operate an initiation system of the fuze; and wherein the power source is a power source of the munition, and the visible marker and indicator strip are located in a housing which is retrofittable to the munition, such that the housing operatively engages with the munition's power source.

19. The device according to claim 18, wherein the visible marker is configured to switch to the on state prior to intended activation, thereby indicating unintended activation.

20. The device according to claim 14, wherein the indicator strip is a thermochromic or electrochromic indicator strip.

* * * * *